United States Patent [19]

Blairsdale

[11] 4,078,848

[45] Mar. 14, 1978

[54] CONVERTIBLE ELECTRICAL PLUG

[76] Inventor: Donald A. Blairsdale, 1622 Michael Dr., Pinole, Calif. 94564

[21] Appl. No.: 685,787

[22] Filed: May 13, 1976

Related U.S. Application Data

[63] Continuation-in-part of Ser. No. 555,222, Mar. 4, 1975.

[51] Int. Cl.[2] ..... H01R 3/06

[52] U.S. Cl. ..... 339/14 P; 339/195 A; 339/255 R

[58] Field of Search ..... 339/14 P, 14 R, 14 RP, 339/195 A, 195 R, 195 M, 195 S, 196 A, 255 R, 255 P, 31 R, 45 R

[56] References Cited

U.S. PATENT DOCUMENTS

| | | | |
|---|---|---|---|
| 2,986,718 | 5/1961 | Bender, Jr. | 339/14 RP |
| 3,754,202 | 8/1973 | Nelson | 339/14 P |
| 3,786,392 | 1/1974 | McDaniel | 339/14 P |
| 3,922,600 | 11/1975 | Roveti | 339/45 R X |

*Primary Examiner*—Roy Lake
*Assistant Examiner*—De Walden W. Jones
*Attorney, Agent, or Firm*—Schapp and Hatch

[57] ABSTRACT

A convertible electrical plug is disclosed in which one of the prongs is a retractable grounding prong movable between a forwardly projecting active position and a rearwardly projecting inactive position, the grounding prong being releasably locked in the active position for insertion into a three-prong receptacle and movable to the inactive position for insertion of the plug into a two-prong receptacle. In one form of the invention, the grounding prong is axially reciprocable in a metal tube connected to the ground wire of the electrical cord, and a manually engageable latch releasably locks the grounding prong in its active position. A spring is provided for automatically urging the grounding prong to its latched, active position. In another form of the invention, the grounding prong has an end pivotally mounted in a channel in the plug body, with the prong being swingable about the pivot between its active position and inactive position. The channel is metallic and electrically conductive and is connected to the ground wire of a three-wire electrical cord. The lips of the conductive channel are made to project inwardly and resiliently engage the grounding prong, releasably locking the grounding prong in either its active or inactive position.

10 Claims, 12 Drawing Figures

CONVERTIBLE ELECTRICAL PLUG

REFERENCE TO RELATED APPLICATION

This application is a continuation-in-part of my copending application, Serial No. 555,222, filed March 4, 1975 for ELECTRICAL PLUG.

The present invention relates to a convertible electrical plug, and more particularly to electrical plugs which can be manually converted from three-prong plugs to two-prong plugs and vice versa.

BACKGROUND OF THE INVENTION

It is now well known to reduce or eliminate shock hazard by providing electrical tools and applicances with three-wire power cords terminating in three-prong plugs adapted to be plugged into three-wire grounded receptacles.

Such three-prong plugs have two power prongs, corresponding generally in structure and function to the prongs of the plugs used in connection with conventional two-wire electrical systems, and a third or grounding plug adapted to engage the grounded female contacts of three-wire grounded receptacles.

Unfortunately, many electrical receptacles commonly found in homes and other buildings are of the two-wire ungrounded variety, rather than the three-wire grounded variety. That is to say, many electrical receptacles commonly found in use today are not provided with a grounded contact and corresponding opening adapted to interfit with the grounding prong of a three-prong plug. Adapters are often used to make it possible to utilize the three-prong plugs with conventional two-wire receptacles, but many times such an adapter cannot be found when needed.

This problem is commonly resolved by cutting off the grounding prong of a three-prong plug, thus making it possible to plug the three-prong plug into a two-wire receptacle, but at the same time "accepting" the attendant shock hazard of an ungrounded system. After being thus mutilated, the three-prong plug can still be plugged into a three-wire receptacle, but cannot be used to take advantage of the shock protection offered by the grounded contact in the third opening.

One known method of dealing with this problem is to make the grounding prong removable from the plug. However, the removed grounding prong is often lost. Another known method of dealing with this problem is to mount the grounding prong of a three-prong plug so it can be retracted, either axially or pivotally, to an inoperative position for use with a two-prong receptacle, and then moved back to operative position for use with a three-prong grounded receptacle. The pivoting method has not been entirely satisfactory because of the poor electrical conducting properties of the simple type of pivot generally used and which is subject to wear and corrosion, sometimes resulting in a faulty ground connection and failure to protect from electrical shock when the user believes he is protected.

In certain countries, such as the United States, convertible electrical plugs of the type under discussion must meet certain requirements imposed by regulating bodies such as the Underwriters Laboratories (UL).

To obtain UL approval, the grounding prong must be self-restoring, that is, it must automatically move back to its extended, active position whenever the device is removed from a two-prong receptacle. Previous inventors have made the grounding prongs axially retractable and have provided them with springs tending to urge the prongs to extended, active position, see U.S. Pat. No. 3,924,914. However, in this construction if the spring is made strong enough to force the grounding prong into the grounding aperture in a three-prong receptacle, the same spring tends to push against the receptacle and extract the power prongs from a two-prong receptacle. Attempts have been made to overcome this problem by providing a removable pin engageable through a hole in the grounding prong and bearing against the plug housing to hold the prong in its active, extended position, as exemplified in U.S. Pat. No. 3,786,392. The separate pin is particularly subject to loss.

U.S. Pat. No. 3,685,000 provides a peripheral groove in the grounding prong engageable by a hook on a grounding wire extending from the plug. However, these grounding wires are notoriously subject to wear and after a few uses can easily break and be detached from the plug. In each of these instances, the absence of the means for holding the grounding prong in extended position tends to result in the aforesaid problem of the spring pulling the power prongs out of the receptacle.

An attempt has been made to provide an internal latch in the grounding prong which is released when the end of the prong is urged against the receptacle plate, see U.S. Pat. No. 3,754,202. However, the mounting of the latch internally of the grounding prong necessarily results in a tiny and complicated mechanism.

These and other difficulties experienced with the prior art devices have been obviated in a novel manner by the present invention.

SUMMARY OF THE INVENTION

The convertible electrical plug of the present invention provides a ground prong movable between a forwardly projecting active position and a rearwardly projecting inactive position and retaining means in the body of the plug formed for releasably holding the grounding prong in its active position. In a preferred form of the invention, the grounding prong is self-restoring to its extended position where it is held firmly by a latch device which can be released simply by pressing a button. When the grounding prong is in its inactive position, this fact is communicated to the user by a portion of the grounding prong extending rearwardly of the plug in position for visual observation. The mechanism is strong, self-contained, and has no removable parts or parts exposed to breakage.

It is therefore a principal object of the present invention to provide a three-prong electrical plug which is easily manually convertible for use with two-wire receptacles, substantially instantaneously and without tools.

Another object of the present invention is the provision of a three-prong electrical plug which is easily adapted for use as a two-prong plug and which has no external parts which could be detached and lost.

A further object of the present invention is the provision of an electrical plug of the character described in which the grounding prong is held in its active position by a secure lock, with said lock being instantly releasable when it is desired to insert the electrical plug in a two-prong receptacle.

A still further object of the present invention is to provide an electrical plug of the character described in which the grounding prong is automatically self-restoring to its active position when the power prongs are withdrawn from a two-prong receptacle.

Another object of the invention is to provide a convertible electrical plug of the character described in which a portion of the grounding prong extends rearwardly in position for visual observation when the grounding prong is in its retracted, inactive position thus indicating the plug is not grounded.

Yet another object of the present invention is the provision of an electrical plug having an axially retractable grounding prong and a releasable latch contained in the insulated body of the plug for automatically snapping behind a shoulder on the grounding prong and holding the latter in its extended position until the latch is released by pressing a manually engageable button on the exterior of the plug.

A still further object of the present invention is the provision of an electrical plug having a pivotable grounding prong in which the ground connection is made through a pair of relatively large area contacts which are resiliently pressed together, and in which the ground contact is not made solely through a pivot.

Yet another object of the present invention is the provision of a three-prong plug having a pivotable grounding prong which in its inactive position is maintained largely within the body of the plug, and thus does not prevent the insertion of another plug into a closely adjacent two-prong receptacle.

An additional object of the present invention is the provision of a convertible electrical plug having a retractable grounding electrode, in which the grounding electrode assembly consists of a minimum of parts, all of which parts can be easily fabricated in large volume on standard mass production metal working machinery.

Other objects, features and advantages of the present invention not specifically set out herein will be apparent from the following description, taken in connection with the accompanying drawings.

DESCRIPTION OF THE PREFERRED EMBODIMENTS

Figure 1:
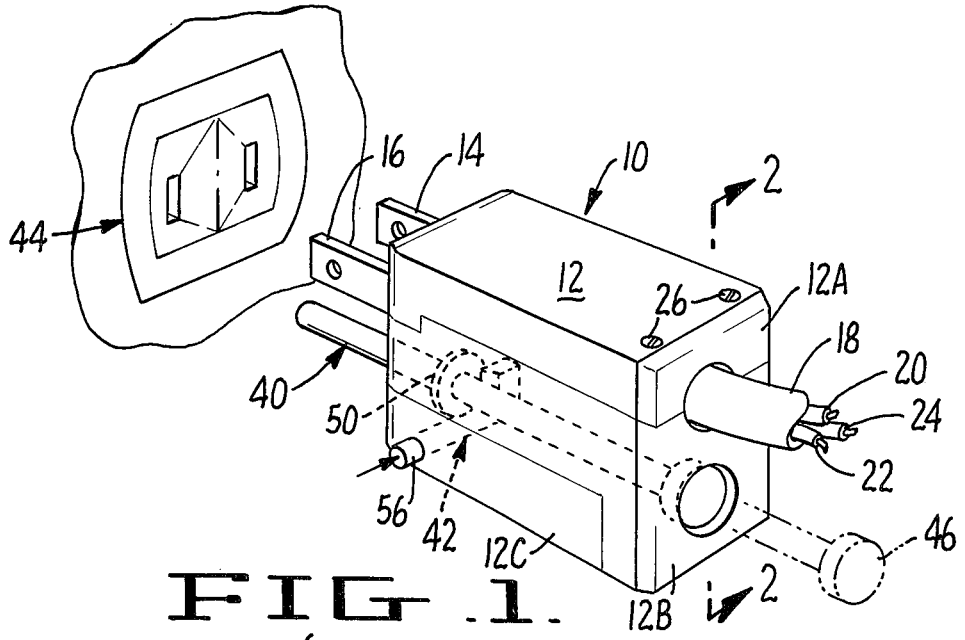
FIG. 1 is a perspective view of the preferred embodiment of the convertible three-prong grounding plug of the present invention, showing the grounding prong in its active position in solid lines and indicating the inactive position of the grounding prong in phantom.

As illustrated in the accompanying drawings, the convertible electrical plug 10 of the present invention includes an insulating body 12, which is preferably fabricated from an insulating material such as rubber or one of the well-known equivalent plastic materials. Power prongs 14 and 16 are incorporated in plug body 12 in the well-known manner, e.g., by molding in a unitary plug body or by embedding in correspondingly shaped recesses in a multi-part body. A three-wire power cord 18 is also incorporated into plug body 12 and comprises an outer insulating jacket containing three separately insulated wires 20, 22 and 24. Wire 20 is connected to power prong 14 and wire 22 is connected to the outer power prong 16.

In accordance with the present invention, the electrical plug 10 is provided with a retractable grounding prong 40 mounted in the body 12 for movement between a forwardly projecting active position and a rearwardly projecting inactive position, with the grounding prong 40 being in substantially parallel spaced relation to the power prongs 14 and 16 in both of said positions. Retaining means 42 in the body 12 is formed for releasably locking the grounding prong 40 in its active position for insertion into the corresponding aperture in a conventional three-prong receptacle (not shown).

Also in accordance with the present invention, the grounding prong extends rearwardly from the body 12 and is visible thereat only when in the inactive or retracted position. Thus, whenever the power prongs 14 and 16 are inserted into a conventional two-prong receptacle, such as that illustrated at 44, grounding prong 40 must necessarily be moved to its retracted or inactive position, where a mere glance will indicate that the plug and the ground wire 24 in the attached cord 18 are not grounded.

In the form of the invention illustrated in FIGS. 1 through 7 of the drawings, the grounding prong 40 is axially retractable to its inactive position. As may best be seen in FIGS. 1 and 5 in the drawings, when grounding prong 40 is retracted, the rearward end (that is, the end remote from the end which inserts into a grounded receptacle) projects some distance to the rear of the plug body 12 for easy visual observation. If desired, an enlarged knob 46 may be provided on the rearward end of grounding prong 40 and may be brightly colored to make it more visible.

Figure 4:
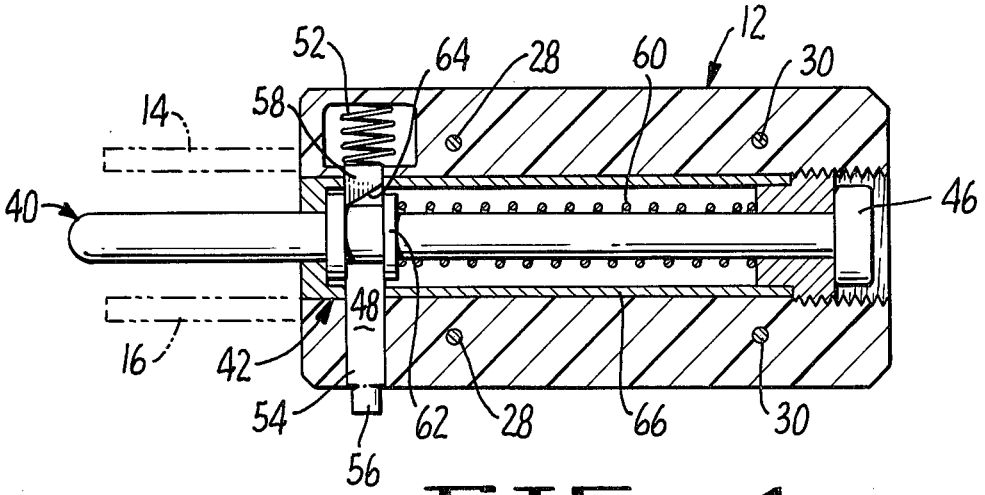
FIG. 4 is a plan cross-sectional view through the retractable grounding prong and associated latch mechanism of the present invention and is taken substantially on the plane of line 4—4 of FIG. 2.
Figure 5:
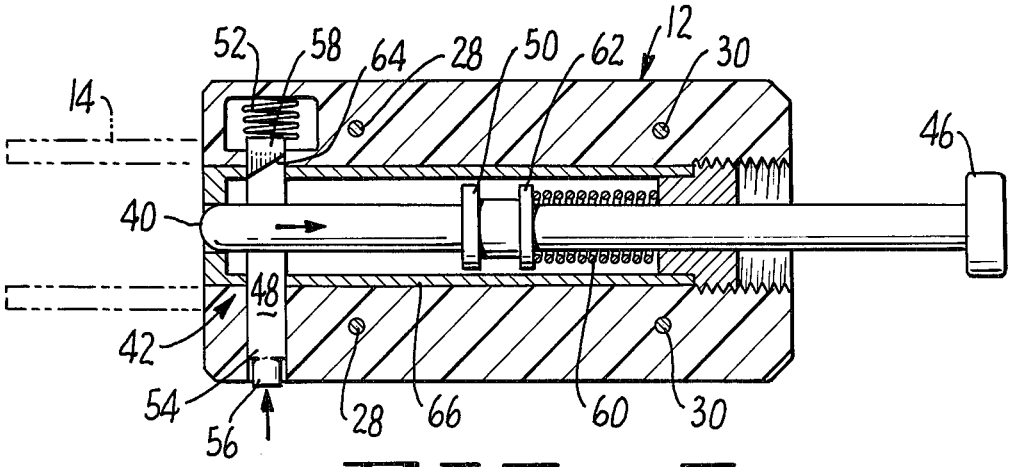
FIG. 5 is a view substantially similar to that of FIG. 4, but illustrating the parts in their inactive, retracted position.
Figure 6:
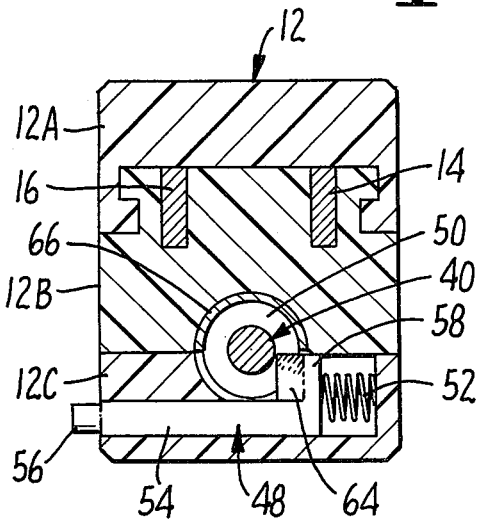
FIG. 6 is a vertical cross-sectional view taken substantially on the plane of line 6—6 of FIG. 2.
Figure 7:
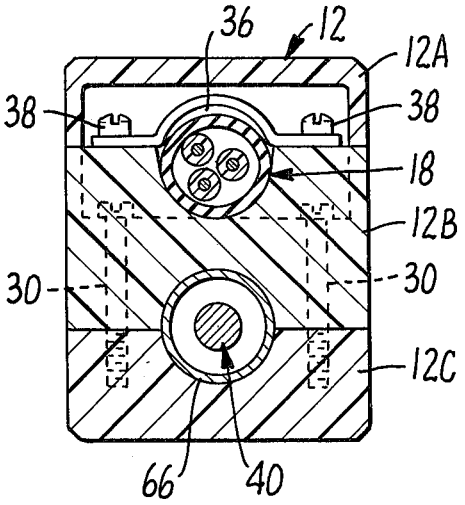
FIG. 7 is a vertical cross-sectional view taken substantially on the plane of line 7—7 of FIG. 2.

In the form of the invention shown in FIGS. 1 through 7 of the drawings, retaining means 42 includes a latch member 48 mounted for endwise reciprocation in body 12 in a direction normal to the axial movement of grounding prong 40. Latch member 48 is formed and proportioned to engage behind a shoulder provided by a flange 50 on grounding prong 40 when the grounding prong is in its active position, as illustrated in FIG. 4 of the drawings. Resilient means in the form of a spring 52 is mounted in body 12 to bear against latch member 48, tending to keep the member 48 in latched position behind flange 50.

When it is desired to release the latch and allow grounding prong 40 to be moved to its inactive, retracted position, the portion of latch member 48 engaged behind flange 50 is moved far enough away from grounding prong 40 to clear the periphery of flange 50. For this purpose, latch member 48 has an extension 54 terminating in a manually engageable button 56 at the exterior of the plug body 12. As may best be seen in FIG. 6, the latch member 48 is of L-shape, with the upturned end 58 being the portion which engages behind flange 50 to hold grounding prong 40 in its extended, active position. With button 56 pressed in and the latch released, insertion of power prongs 14 and 16 into a two-prong receptacle 44 causes the grounding prong 40 to be engaged and pushed back into the plug body by the face of receptacle 44 to the retracted, inactive position illustrated in FIG. 5 of the drawings.

As an important feature of the invention illustrated in FIGS. 1 through 7 of the drawings, the grounding prong 40 is self-restoring and automatically moves back to its extended active position and is locked there until button 56 is again pushed in. For this purpose, a helical compression spring 60 is positioned around grounding prong 40, bearing against a portion of housing 12 and a flange 62 secured to grounding prong 40. As grounding prong 40 moves back to its extended, active position, flange 50 encounters an inclined face formed on latch portion 58. Further movement of flange 62 to the left, as viewed in FIG. 4, urges portion 58 away from grounding prong 40 against the influence of spring 52 allowing flange 50 to move further to the left until portion 58 snaps down behind it and securely locks the grounding prong 40 in extended position until the latch is again released.

In the form of the invention illustrated in FIGS. 8 through 12, the convertible electrical plug 110 includes an insulating body 112, which is preferably fabricated from an insulating material such as rubber or one of the well-known equivalent plastic materials. Power prongs 114 and 116 are incorporated in plug body 112 in the well-known manner, e.g., by molding. A three-wire power cord 118 is also incorporated in plug body 112, e.g., by molding. Power cord 118 comprises an outer insulating jacket containing three separately insulated wires 120, 122 and 124.

In the well-known manner, wire 122 is connected to power prong 116, and wire 120 is connected to power prong 114. As may best be seen in FIG. 9 of the drawings, wire 120 is connected to power prong 114 by crimping the inner end of power prong 114 over a bared portion of wire 120. Similarly, power prong 116 is connected to the inner end of wire 122 by crimping the inner end of power prong 116 over a bared portion of wire 122.

Figure 2:
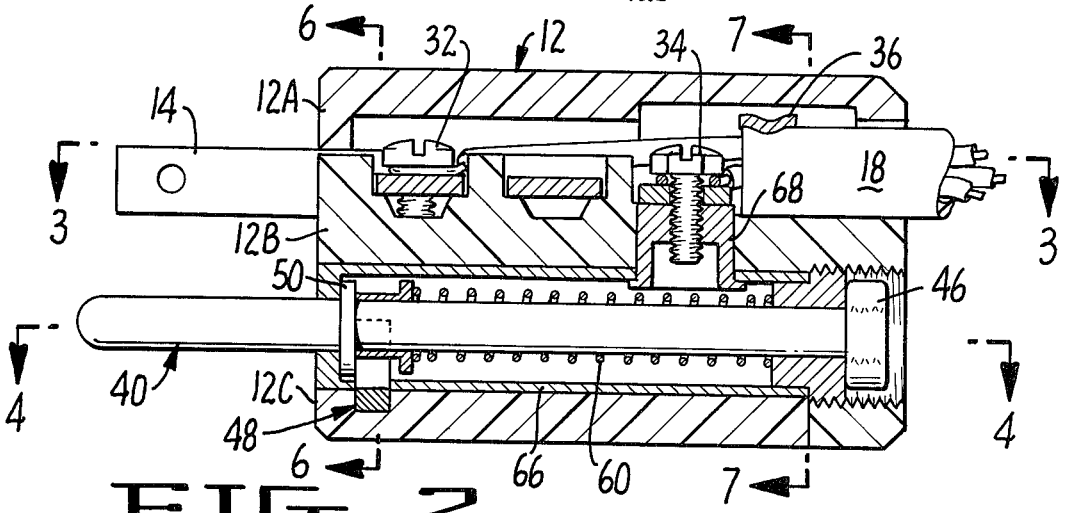
FIG. 2 is a vertical cross-sectional view on an enlarged scale taken substantially on the plane of line 2—2 of FIG. 1.
Figure 3:
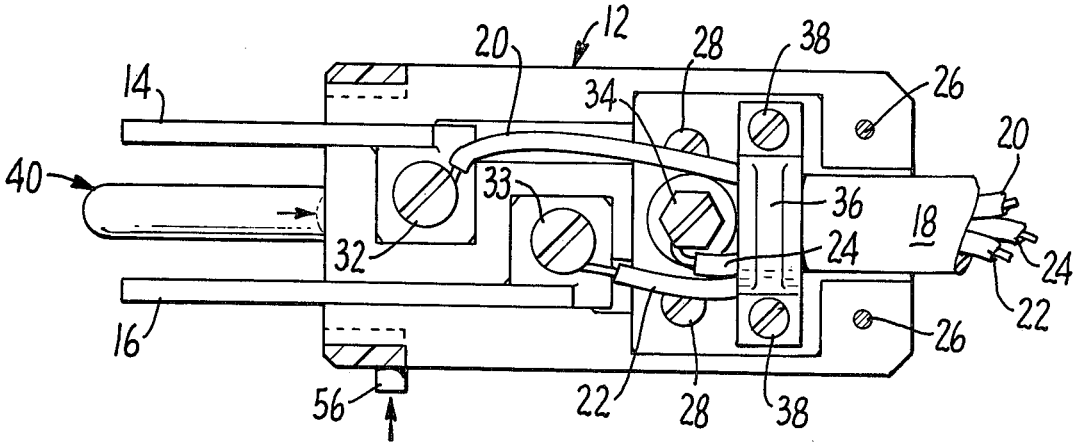
FIG. 3 is a plan cross-sectional view taken substantially on the plane of line 3—3 of FIG. 2.

In the form of the invention illustrated in FIGS. 8 through 12, the grounding prong 144 is pivotally mounted to swing between its extended, active position, illustrated in solid lines in FIG. 2, and its retracted, inactive position, illustrated in phantom lines in FIG. 2. The pivotal mounting of grounding prong 144 holds it securely in place for insertion into a three-prong receptacle, but permits it to be released and swung to the inactive position, while at the same time providing effective electrical connection to ground wire 124 even under conditions of wear.

Figure 8:
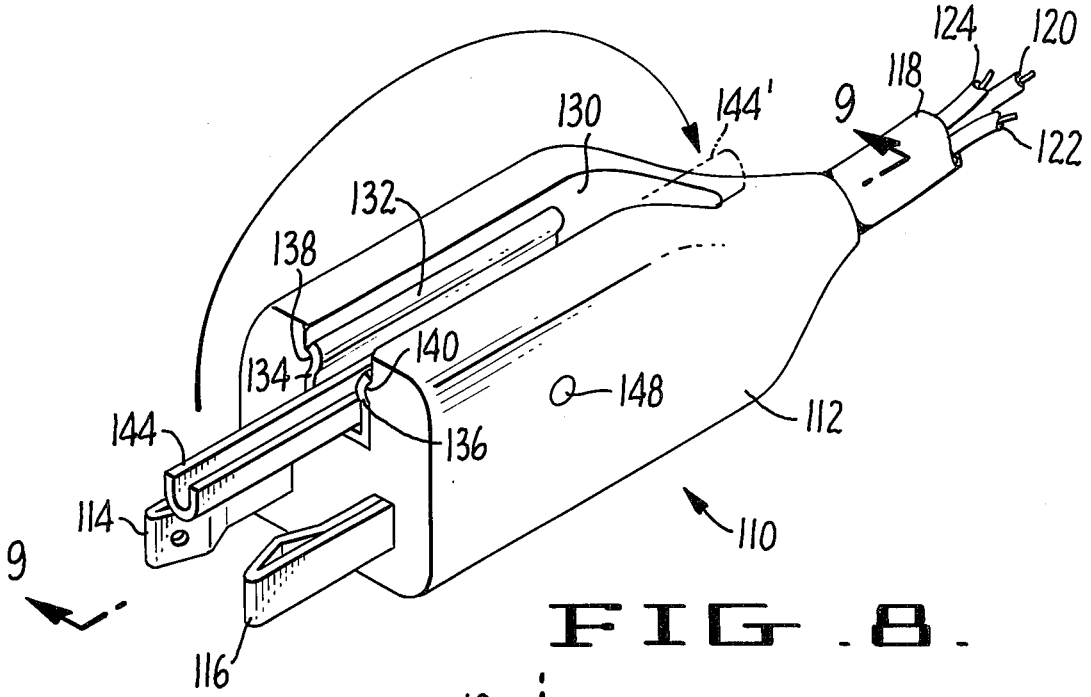
FIG. 8 is a perspective view of a modified form of the convertible three-prong grounding plug of the present invention, showing the grounding prong in its active position in solid lines and indicating the inactive position of the grounding prong in phantom.
Figure 9:
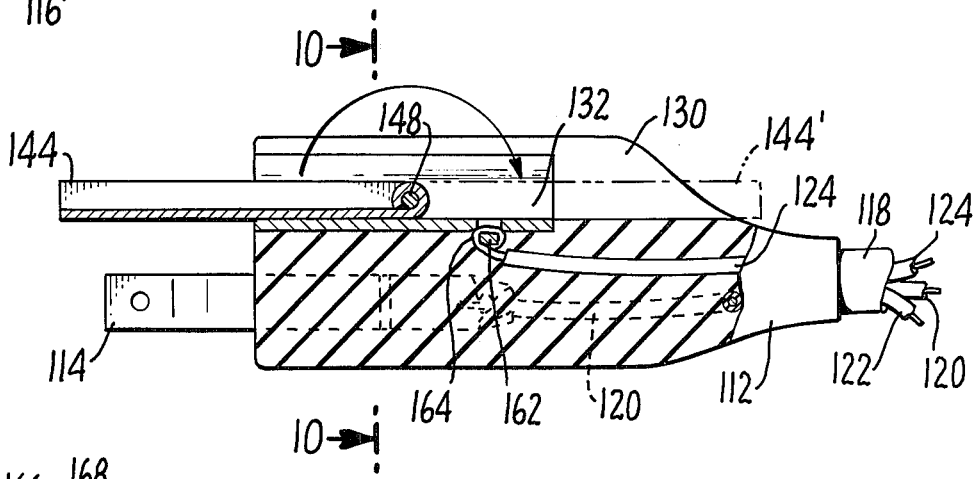
FIG. 9 is a vertical cross-sectional view taken substantially on the plane of line 9—9 of FIG. 8.
Figure 10:
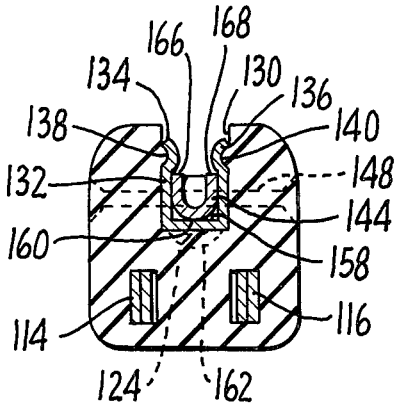
FIG. 10 is a vertical cross-sectional view taken substantially on the plane of line 10—10 of FIG. 9.
Figure 11:
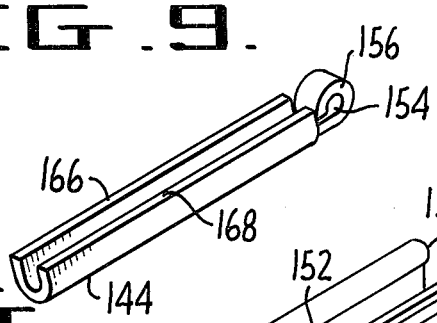
FIG. 11 is a perspective view of a grounding prong forming part of the convertible three-prong grounding plug of FIG. 8.
Figure 12:
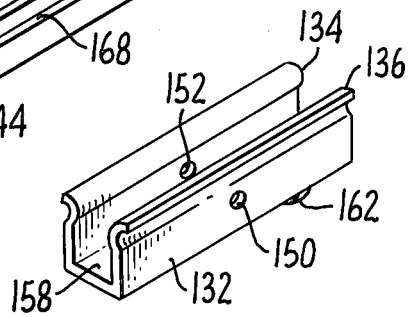
FIG. 12 is a perspective view of a conductive channel member forming part of the convertible three-prong grounding plug of FIG. 8.

As may best be seen in FIGS. 8 through 10, a channel 130 is provided in the side of plug body 112 remote from power prongs 114 and 116. A metallic channel member 132 is tight-fittingly disposed in channel 130. Channel member 132 is formed with inturned portions 134 and 136 along its distal edges, and these portions engage ridges 138 and 140 molded into plug body 112, thereby maintaining channel member 132 in position in channel 130 during assembly.

The grounding prong 144 is disposed within channel member 132 in close-fitting relation. In particular, as may be seen in FIG. 10, the dimensions of grounding prong 144 are so selected with respect to the dimensions of channel member 132 that the inwardly turned portions 134 and 136 of the lips of channel member 132 resiliently press grounding prong 144 downwardly against the bottom of channel member 132, so that a firm, large area contact is maintained between the bottom of grounding prong 144 and the inner bottom face of channel 132 when grounding prong 144 is in its active position. The described action of inwardly turned portions 134 and 136 on grounding prong 144 provides the described retaining means to releasably lock grounding prong 144 into its extended, active position for insertion into a three-prong receptacle.

As shown in FIG. 9, grounding prong 144 is pivotally maintained within conductive channel member 132 by means of a pivot pin 148. Pivot pin 148 is incorporated into plug body 112, as by molding, and extends continuously from side-to-side thereof. Within channel 130, pivot pin 148 passes through holes 150 and 152 in conductive channel 132 and also passes through the passage 154 defined by overturned portion 156 of the grounding prong 144.

As best seen in FIG. 10, the depth of grounding prong 144 is so selected that when grounding prong 144 is in its active position, inwardly turned lips 134 and 136 of conductive channel member 132 firmly urge the bottom of grounding prong 144 against the inner bottom face 158 of conductive channel member 132 over a large contact area 160. As best seen in FIG. 9, conductive channel member 132 is itself connected to ground lead 124 by means of an integral, U-shaped protrusion 162, the bared end 164 of ground lead 124 being interengaged with U-shaped protrusion 162 during assembly, and U-shaped protrusion 162 then being pressed toward its original position to firmly grip bared end 164 and make a low resistance electrical connection therewith. By the novel grounding prong assembly construction just described, grounding prong 144, in its active position, is firmly connected to grounding wire 124 by a low resistance electrical connection which is independent of pivot pin 148. Thus, in accordance with the present invention, a covertible three-prong grounding plug is provided wherein the grounding prong is firmly connected to ground by way of a low resistance electrical connection even after the pivot about which the grounding prong turns from its active to its inactive position has become worn or corroded.

In the form of the invention illustrated in FIGS. 1 through 7 of the drawings, similar provision is made for obtaining a low resistance electrical connection between the grounding prong 40 and ground wire 24 when grounding prong 40 is in its extended, active position. For this purpose, the flanges 50 and 62 are carried in a metallic, electrically conductive tube 66 which carries member 68 into which screw 34 is threaded for effecting connection to ground wire 24. Latch member 48 is also of an electrically conductive metal and its engagement behind flange 50 helps complete the electrically conductive path.

Similarly, as may be seen in FIG. 10 of the drawings, electrical contact between grounding prong 144 and conductive channel member 132 is not only made over contact area 160, but is also made between the two outer edges 166 and 168 of the upper surface of grounding prong 144 and the inner faces of lips 134 and 136 of conductive channel member 132. In accordance with the teachings of the present invention, outer edges 166 and 168 may be slightly chamfered or rounded in order to maximize the area of these additional contacts between grounding plug 144 and conductive channel member 132. It is recognized as an additional feature of the present invention that the configuration of grounding prong 144 and its coaction with the two other parts of the grounding prong assembly are such that the grounding prong 144 need not be fabricated from resilient material, and thus may instead be fabricated from relatively soft conductive metal, which under pressure will have a tendency to conform locally to the inner surfaces of inturned lip portions 134 and 136, thus increasing the total area of contact between grounding prong 144 and conductive channel member 132.

In accordance with the present invention, when grounding prong 144 is swung to its retracted, inactive position, illustrated by phantom lines in FIGS. 8 and 9 of the drawings, the end portion of grounding prong 144 extends from and is visible at the rear of the plug body 112, thus providing visual indication that the grounding prong is not engaged in the grounding aperture of a three-prong receptacle.

From the foregoing, it will be seen that I have provided a novel and useful convertible electrical plug construction in which the grounding prong is securely but releasably held in position for insertion into a three-prong receptacle, with the grounding prong being easily retracted to an inactive position wherein a portion thereof indicates that the plug is not grounded.

What is claimed is:

1. A convertible electrical plug, comprising:
an insulating body;
a plurality of power prongs projecting forwardly in spaced parallel relation from said body and adapted for connection within said body to power wires;
a grounding prong mounted in said body for axial movement between an active position projecting forwardly from said body and an inactive position not projecting forwardly from said body, with said grounding prong being in substantially parallel spaced relation to said power prongs in both of said positions;
captive retaining means mounted in said body formed for releasably engaging and locking said grounding prong in said active position;
and grounding means in said body electrically connected to said grounding prong and adapted for connection to a grounding wire.

2. A convertible electrical plug, comprising:
an insulating body;
a plurality of power prongs projecting forwardly in spaced parallel relation from said body and adapted for connection within said body to power wires;
a grounding prong mounted in said body for axial movement between an active position projecting forwardly from said body and an inactive position not projecting from said body, with said grounding prong being in substantially parallel spaced relation to said power prongs in both of said positions;
retaining means mounted on said body formed for releasably engaging and locking said grounding prong in said active position;
and grounding means in said body electrically connected to said grounding prong and adapted for connection to a grounding wire;
said grounding prong extending rearwardly from said housing and visible thereat only when in said inactive position.

3. A convertible electrical plug, comprising:
an insulating body;
a plurality of power prongs projecting forwardly in spaced relation from said body and adapted for connection within said body to power wires;
a grounding prong adapted for connection to a grounding wire and mounted in said body for axially reciprocable movement between an active position with an end thereof projecting forwardly of said body in parallel spaced relation to said power prongs and an inactive position with said end retracted substantially within said body;
retaining means in said body formed for releasably locking said grounding prong against retraction from said active position;
spring means in said body biased to urge said grounding prong from said inactive position to said active position;
a marker element connected to said grounding prong for movement therewith and formed to extend rearwardly of said plug for visual observation when said grounding prong is moved to said inactive position against the bias of said spring means.

4. A convertible electrical plug as claimed in claim 1 and wherein restoring means in said body is formed for automatic return of said grounding prong to said active position when not being held in said inactive position.

5. A convertible electrical plug as claimed in claim 4 and wherein said retaining means includes a latch mounted in said body and engageable with a portion of said grounding prong for holding same in said active position, said latch having a portion extending to the exterior of said plug and formed for manual displacement for selectively releasing said latch to allow said grounding prong to be moved to said inactive position.

6. A convertible electrical plug as claimed in claim 5 and wherein said restoring means also includes resilient means biasing said grounding prong to said active position for effecting automatic return of said grounding prong to its said active position.

7. A convertible electrical plug, comprising:
an insulating body;
a plurality of power prongs projecting forwardly in spaced relation from said body and adapted for connection within said body to power wires;
a grounding prong adapted for connection to a grounding wire and mounted in said body for axially reciprocable movement between an active position with an end thereof projecting forwardly of said body in parallel spaced relation to said power prongs and an inactive position with said end retracted substantially within said body;
a shoulder formed on said grounding prong;
a spring biased latch in said body engageable with said shoulder and formed for releasably locking said grounding prong against retraction from said active position;

and spring means in said body biased to urge said grounding prong from said inactive position to said active position.

8. A convertible electrical plug as claimed in claim 7 and wherein said latch is mounted internally of said body and has a portion extending to the exterior of said body for manual engagement and displacement to release said latch from engagement with said shoulder.

9. A convertible electrical plug as claimed in claim 3 and wherein said grounding prong is of conductive metal and is slidable in a tube of electrically conductive metal mounted within said plug and adapted for electrical connection to a ground wire, and said spring means comprises a helical compression spring mounted within said tube in surrounding relation to said grounding prong and bearing against a collar on said grounding prong and an internal collar on the rearward end of said tube.

10. A convertible electrical plug, comprising:

a body formed of insulating material and adapted to be carried on an end of an electrical cord having power wires and a ground wire;

a plurality of power prongs projecting forwardly in spaced relation from said body and adapted for connection within said body to the power wires;

a grounding prong adapted for connection to the grounding wire and mounted in said body for axially reciprocable movement between an active position wherein an end thereof projects forwardly of said body in parallel spaced relation to said power prongs and an inactive position wherein said end is retracted substantially within said body;

a shoulder formed on said grounding prong within said body;

a latch member mounted within said body in position to intercept and engage said shoulder for holding said grounding prong in said active position;

a spring mounted within said body and biasing said latch toward said grounding prong;

a manually engageable member extending from the exterior of said plug to the interior thereof and connected to said latch member for selectively releasing said latch member from engagement with said shoulder to permit said grounding prong to be moved to said inactive position;

a marker element connected to said grounding prong for movement therewith and formed to extend rearwardly of said plug for visual observation when said grounding prong is moved to said inactive position;

a tube of electrically conductive metal mounted within said plug and adapted for electrical connection to the ground wire, said tube slidably receiving said grounding prong in electrical contact therewith; and a helical compression spring mounted within said tube in surrounding relation to said grounding prong and bearing against a collar on said grounding prong and an in-turned collar on the rearward end of said tube for biasing said grounding prong from said inactive position to said active position.

* * * * *